US011169473B2

(12) United States Patent
Yokoyama et al.

(10) Patent No.: US 11,169,473 B2
(45) Date of Patent: Nov. 9, 2021

(54) IMAGE FORMING APPARATUS WITH IMAGE BEARING MEMBER AND A BELT THAT CONTACT EACH OTHER TO FORM A WOUND AREA BY URGING A TRANSFER MEMBER TOWARD THE IMAGE BEARING MEMBER

(71) Applicant: CANON KABUSHIKI KAISHA, Tokyo (JP)

(72) Inventors: Ken Yokoyama, Mishima (JP); Hiroyuki Seki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/824,548

(22) Filed: Mar. 19, 2020

(65) Prior Publication Data

US 2020/0310303 A1 Oct. 1, 2020

(30) Foreign Application Priority Data

Mar. 28, 2019 (JP) ..... JP2019-063893
May 22, 2019 (JP) ..... JP2019-096200

(51) Int. Cl.
*G03G 15/16* (2006.01)

(52) U.S. Cl.
CPC ..... *G03G 15/162* (2013.01); *G03G 15/1615* (2013.01)

(58) Field of Classification Search
None
See application file for complete search history.

(56) References Cited

U.S. PATENT DOCUMENTS 6,085,058 A * 7/2000 Goto ..... G03G 15/167 399/313
6,453,139 B2 * 9/2002 Sasame ..... G03G 15/0194 399/167
7,283,768 B2 * 10/2007 Bandou ..... G03G 15/1685 399/159
2005/0025535 A1 * 2/2005 Koichi ..... G03G 15/167 399/313
2009/0097888 A1 * 4/2009 Hirai ..... G03G 15/1605 399/308
2015/0338783 A1 * 11/2015 Matsushita ..... G03G 15/1685 399/299

FOREIGN PATENT DOCUMENTS

JP 2001-75379 A 3/2001
JP 2006-308758 A 11/2006
JP 2007-233100 A 9/2007
JP 2008-170968 A 7/2008
JP 2014-191130 A 10/2014
WO 02/056119 A1 7/2002

OTHER PUBLICATIONS

JP_2014191130_A_T Machine Translation, 2014, Japan, Iijima.*

* cited by examiner

*Primary Examiner* — Victor Verbitsky
(74) *Attorney, Agent, or Firm* — Canon U.S.A., Inc., IP Division

(57) ABSTRACT

A primary transfer roller is disposed upstream or downstream from the center of rotation of a photosensitive drum in the moving direction of an intermediate transfer belt. The primary transfer roller includes a core metal and an elastic layer coating the outer circumference of the core metal and having a thickness of less than 2.0 mm. The primary transfer roller has an Asker-C hardness of 40° or higher and 85° or lower.

15 Claims, 11 Drawing Sheets

IMAGE FORMING APPARATUS WITH IMAGE BEARING MEMBER AND A BELT THAT CONTACT EACH OTHER TO FORM A WOUND AREA BY URGING A TRANSFER MEMBER TOWARD THE IMAGE BEARING MEMBER

BACKGROUND OF THE INVENTION

Field of the Invention

The present disclosure relates to electrophotographic image forming apparatuses, such as copying machines and printers.

Description of the Related Art

A known example of electrophotographic image forming apparatuses is a tandem image forming apparatus including a plurality of image forming units arranged in the moving directions of belts, such as a conveying belt and an intermediate transfer belt. The image forming units of individual colors each include a photosensitive member (hereinafter referred to as "photosensitive drum") serving as an image bearing member. The color toner images borne on the color photosensitive drums are transferred to paper or an overhead projector (OHP) sheet conveyed by a transfer-material conveying belt, or are once transferred to an intermediate transfer belt and then to a transfer material, and are then fixed to the transfer material by a fixing unit. The transfer of the toner images from the photosensitive drum to the transfer material or the intermediate transfer belt is executed by applying a voltage to a transfer member disposed on the opposite side of the transfer material conveying belt or the intermediate transfer belt from the photosensitive drum.

Japanese Patent Laid-Open No. 2001-75379 discloses a configuration in which each belt is wound around the photosensitive drum by urging the transfer member toward the photosensitive drum so that a large belt-wound area is formed at a transfer portion where the belt and the photosensitive drum come into contact with each other to thereby increase the transfer performance.

SUMMARY OF THE INVENTION

The present disclosure provides an image forming apparatus that secures an appropriate wound area to increase the transfer performance in a configuration in which an image bearing member and a belt are brought into contact with each other to form the wound area by urging a transfer member toward the image bearing member.

An image forming apparatus according to an aspect of the present disclosure includes a rotatable image bearing member configured to bear a toner image, a movable endless belt configured to come into contact with the image bearing member, and a transfer member disposed on an opposite side of the belt from the image bearing member. The transfer member is configured to come into contact with the belt and transfer the toner image from the image bearing member to the belt. The moving speed of the belt and the rotation speed of the image bearing member at a position where the image bearing member and the belt come into contact with each other differ from each other. The transfer member is disposed upstream or downstream from the center of rotation of the image bearing member in the moving direction of the belt, the transfer member being urged toward the image bearing member to push the image bearing member via the belt to form a region where the belt winds around the image bearing member. The transfer member includes a core metal and an elastic layer coating the outer circumference of the core metal and having a thickness of less than 2.0 mm. The transfer member has an Asker-C hardness of 40° or higher and 85° or lower.

Further features of the present disclosure will become apparent from the following description of exemplary embodiments with reference to the attached drawings.

DESCRIPTION OF THE EMBODIMENTS

Embodiments of the present disclosure will be described in detail hereinbelow with reference to the drawings. It is to be understood that the sizes, materials, and shapes of the components described in the embodiments, and relative arrangement among the components may be changed as appropriate depending on the configuration of the apparatus to which the present disclosure is applied and various conditions. Accordingly, the scope of the present invention is not limited unless otherwise specified.

First Embodiment

Figure 1:
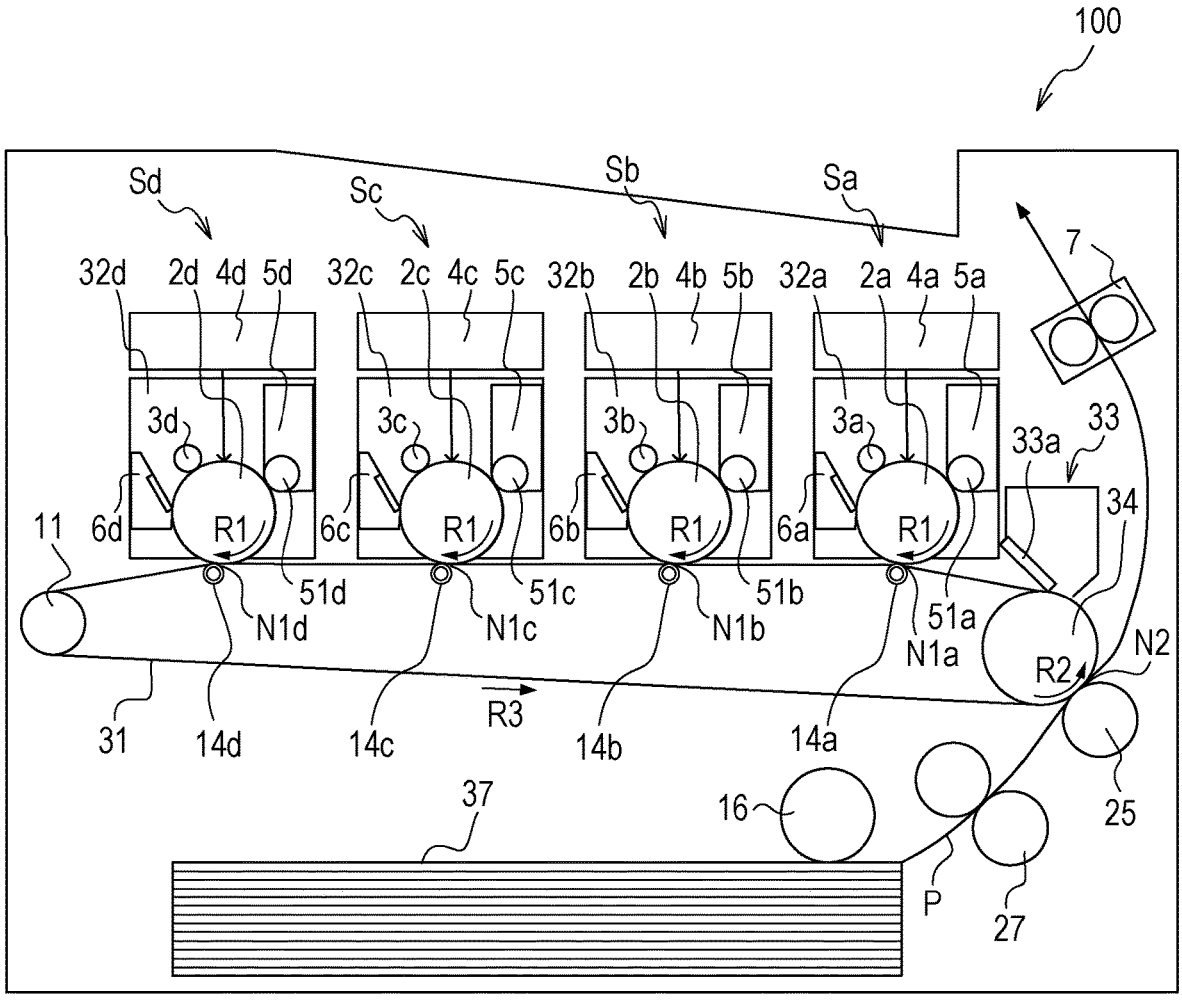
FIG. 1 is a schematic cross-sectional view of an image forming apparatus 100 according to a first embodiment illustrating, in outline, the configuration thereof.

FIG. 1 is a schematic cross-sectional view of an image forming apparatus 100 according to the present embodiment illustrating, in outline, the configuration thereof. The image forming apparatus 100 of the present embodiment is a tandem laser beam printer that adopts an intermediate transfer system capable of forming a full-color image using an electrophotographic system.

The image forming apparatus 100 includes four image forming units Sa, Sb, Sc, and Sd arranged in a line. The image forming units Sa, Sb, Sc, and Sd form yellow (Y), magenta (M), cyan (C), and black (K) images, respectively. In the present embodiment, the configurations and operations of the image forming units Sa, Sb, Sc, and Sd are substantially the same except the colors of toners used. Accordingly, the trailing signs a, b, c, and d indicating that the components are for any of the colors will be omitted, and an overall description will be given for the components.

The image forming unit S includes a drum-shaped (cylindrical) photosensitive drum 2 serving as an image bearing member. The photosensitive drum 2 is rotatable in the direction of arrow R1 in the drawing at a predetermined circumferential velocity Vd (rotational speed) by receiving a driving force. Around the photosensitive drum 2, a charging roller 3, which is a roller-shaped charging member serving as a charging unit, an exposure unit 4, a developing unit 5, and a drum cleaning unit 6 that collects toner remaining on the photosensitive drum 2 are arranged in this order in the direction of rotation.

The developing unit 5 has a nonmagnetic one-component developer therein as a developer and includes a developing roller 51 serving as a developer bearing member. In each image forming unit S, the photosensitive drum 2, and the charging roller 3, the developing unit 5, and the drum cleaning unit 6, which are processing units acting on the photosensitive drum 2, are configured as a process cartridge 32 which is detachably mounted to the main body of the image forming apparatus 100. The exposure unit 4 is a scanner unit that scans laser light using a polygonal mirror and applies a scanning beam modulated on the basis of an image signal onto the photosensitive drum 2.

An intermediate transfer belt 31 which is an endless belt serving as a movable intermediate transfer member is disposed in contact with all of the respective photosensitive drums 2*a*, 2*b*, 2*c*, and 2*d* of the image forming units Sa, Sb, Sc, and Sd. The intermediate transfer belt 31 is stretched by a driving roller 34 (a driving member) and a stretching roller 11. Since the driving roller 34 is rotationally driven in the direction of arrow R2 in the drawing, the intermediate transfer belt 31 is moved (rotated) in the belt conveying direction indicated by arrow R3 at a predetermined circumferential velocity Vb (a moving speed).

A primary transfer roller 14 serving as a primary transfer member (a transfer member) is disposed on the opposite side of the intermediate transfer belt 31 from the photosensitive drum 2. The primary transfer roller 14 is urged against the photosensitive drum 2 with a predetermined pressure via the intermediate transfer belt 31 to form a primary transfer portion N1 (a transfer portion) which is an area where a toner image is transferred from the photosensitive drum 2 to the intermediate transfer belt 31. A secondary transfer roller 25 serving as a secondary transfer member is disposed at a position of the outer circumferential surface of the intermediate transfer belt 31 opposed to the driving roller 34. The secondary transfer roller 25 is urged against the driving roller 34 with a predetermined pressure via the intermediate transfer belt 31 to form a secondary transfer portion N2 at which the intermediate transfer belt 31 and the secondary transfer roller 25 come into contact with each other.

A cleaning unit 33 including a cleaning blade 33*a* serving as a collecting unit is disposed at a position on the outer circumferential surface of the intermediate transfer belt 31 opposed to the driving roller 34.

When an image forming operation is started, the photosensitive drum 2 and the intermediate transfer belt 31 start to rotate in the directions of arrows R1 and R3, respectively, at predetermined circumferential velocities. The surface of the rotating photosensitive drum 2 is substantially uniformly, electrically charged to a predetermined polarity (in the present embodiment, negative polarity) by the charging roller 3. At that time, the charging roller 3 receives a predetermined charging voltage applied from a charging power source (not illustrated). Thereafter, the photosensitive drum 2 is exposed to light by the exposure unit 4 according to image information for each image forming unit S, so that an electrostatic latent image based on the image information is formed on the surface of the photosensitive drum 2. The electrostatic latent image formed on the photosensitive drum 2 is visualized on an opposing portion (a developing portion) between the photosensitive drum 2 and the developing roller 51 with a negative toner carried by the developing roller 51, so that a toner image is formed on the photosensitive drum 2.

Next, the toner image formed on the photosensitive drum 2 is transferred (primarily transferred) to the rotationally driven intermediate transfer belt 31 at the primary transfer portion N1 by the action of the primary transfer roller 14. At that time, the primary transfer roller 14 receives a primary transfer voltage of the opposite polarity (positive in the present embodiment) to the normal charge polarity of the toner from a primary-transfer power source (not illustrated). For example, in forming a full-color image, an electrostatic latent image is formed on the photosensitive drum 2 of the image forming unit S, and the electrostatic latent image is developed into a corresponding color toner image. The individual color toner images formed on the photosensitive drums 2 of the image forming units S are transferred to the intermediate transfer belt 31 one on another at the primary transfer portions N1*a*, N1*b*, N1*c*, and N1*d* to form four color toner images on the intermediate transfer belt 31.

Transfer materials P, such as recording paper, placed in a paper cassette 37 are conveyed to the secondary transfer portion N2 formed between the intermediate transfer belt 31 and the secondary transfer roller 25 by a feeding roller 16 and a conveying roller 27. The four-color multiple toner images carried on the intermediate transfer belt 31 are collectively transferred to the transfer material P at the secondary transfer portion N2 by the action of the secondary transfer roller 25. At that time, the secondary transfer roller 25 receives a secondary transfer voltage of an opposite polarity (a positive polarity in the present embodiment) to the normal charge polarity of the toner) from a secondary transfer power source (not illustrated).

Thereafter, the transfer material P to which the toner image is transferred is conveyed to a fixing unit 7. The toner image that is secondarily transferred to the transfer material P is fixed to the transfer material P by being pressed and heated in the process of being conveyed between a fixing roller and a pressure roller of the fixing unit 7 and is then discharged outside the main body of the image forming apparatus 100.

The image forming apparatus 100 of the present embodiment forms a full-color print image by the above operation.

Transfer residual toner left on the intermediate transfer belt 31 after the secondary transfer is collected into a cleaning unit 33 by a cleaning blade 33*a* opposed to the driving roller 34 with the intermediate transfer belt 31 therebetween and is thus removed from the surface of the intermediate transfer belt 31.

Configuration of Primary Transfer Portion

Figure 2A:
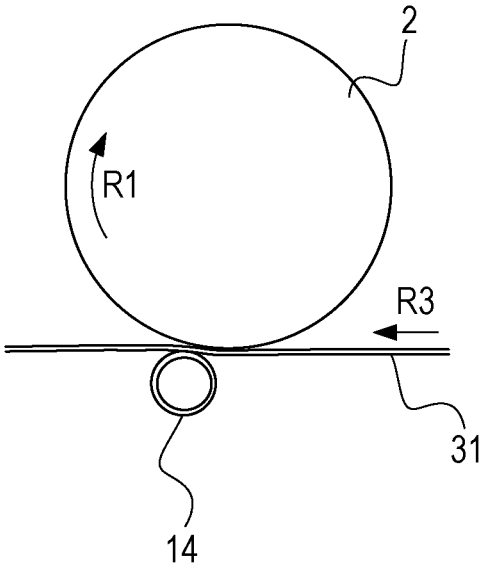
FIGS. 2A and 2B are enlarged schematic cross-sectional views of a primary transfer portion in the first embodiment.
Figure 2B:
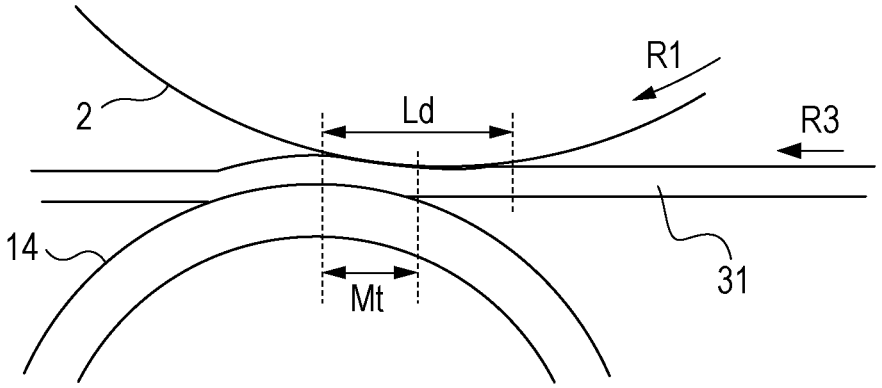

FIG. 2A is an enlarged schematic cross-sectional view of the primary transfer portion N1 in FIG. 1. FIG. 2B is a further enlarged schematic cross-sectional view of the primary transfer portion N1 in FIG. 2A. In the configuration of the present embodiment, the diameter of the photosensitive drum 2 is 24 mm, and the thickness of the intermediate transfer belt 31 is 70 μm. The intermediate transfer belt 31 is stretched with a tension of 98 N by a tension spring (not illustrated). In the present embodiment, the primary transfer roller 14 is urged by springs (not illustrated) toward the photosensitive drum 2 at the opposite ends in the widthwise direction of the intermediate transfer belt 31 perpendicular to the moving direction of the intermediate transfer belt 31. The intermediate transfer belt 31 is stretched by the tension spring with a tension of 98 N in total.

As illustrated in FIG. 2A, the primary transfer roller 14 of the present embodiment is disposed downstream from the center of rotation of the photosensitive drum 2 in the moving direction of the intermediate transfer belt 31 as viewed from the rotation axis of the photosensitive drum 2. As illustrated in FIG. 2B, the primary transfer roller 14 is disposed at a position where the primary transfer roller 14 pushes the photosensitive drum 2 via the intermediate transfer belt 31. The distance of the primary transfer portion N1 at which the photosensitive drum 2 and the intermediate transfer belt 31 come into contact with each other in the moving direction of the intermediate transfer belt 31 is referred to as "nip width Ld". In the present embodiment, the primary transfer roller 14 is urged toward the photosensitive drum 2 by pressure springs (urging units) (not illustrated) disposed at opposite ends of the primary transfer roller 14 in the longitudinal direction. This configuration allows a region in which the primary transfer roller 14 and the intermediate transfer belt 31 come into contact with each other and a region in which the photosensitive drum 2 and the intermediate transfer belt 31 come into contact with each other to overlap to form a region Mt where the intermediate transfer belt 31 winds around the photosensitive drum 2, as illustrated in FIG. 2B.

Figure 3:
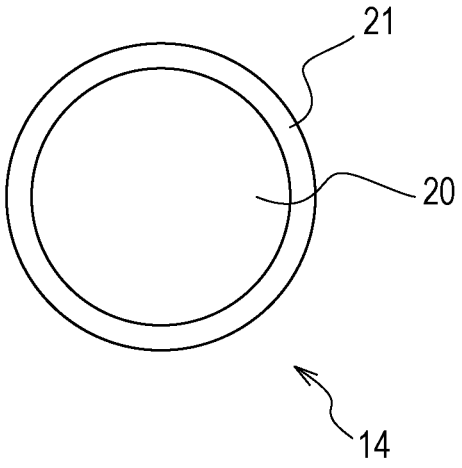
FIG. 3 is a schematic diagram illustrating the configuration of a primary transfer member of the first embodiment.

FIG. 3 is a schematic diagram illustrating the configuration of the primary transfer roller 14 of the present embodiment. As illustrated in FIG. 3, the primary transfer roller 14 includes a core metal 20 made of metal and an elastic layer 21 covering the outer circumference of the core metal 20. The elastic layer 21 has electrical conductivity and has an electrical resistance of about 1 MΩ. The diameter of the core metal 20 is 5.0 mm. The thickness of the elastic layer 21 in the radial direction of the core metal 20 in FIG. 3 is 1.0 mm. In other words, the outside diameter of the primary transfer roller 14 in the present embodiment is 7.0 mm. Thus, the primary transfer roller 14 of the present embodiment has the thin elastic layer 21 as compared with a known primary transfer roller made of sponge rubber or solid rubber.

In the present embodiment, the elastic layer 21 has a solid structure containing an urethane resin as the base material. The elastic layer 21 is made conductive by adding an ionic conductive agent to the base material. It is known that the urethane resin generally has a high adhesion (tackiness) property. For that reason, the present embodiment applies roughing processing to the surface of the elastic layer 21 to reduce the effects of the adhesiveness of the urethane resin between the primary transfer roller 14 and the inner circumferential surface of the intermediate transfer belt 31. In other words the primary transfer roller 14 includes a rough surface on an outer circumference of the elastic layer 21. The elastic layer 21 may not be made of the urethane resin but may be composed mostly of silicone rubber, acrylonitrile-butadiene rubber (NBR), or polyepichlorohydrin rubber.

When the rubber member composed mostly of the urethane resin is used for a long period of time or in a high-temperature, high-humidity environment, if left in pressure-contact with the intermediate transfer belt 31 for a long period of time, a bleeding phenomenon may occur in which low molecular components and conductive components in the rubber are deposited. In the present embodiment, the primary transfer roller 14 is brought into contact with the intermediate transfer belt 31 during image formation at which a toner image is primarily transferred from the photosensitive drum 2 to the intermediate transfer belt 31. After completion of the primary transfer of the toner image, the primary transfer roller 14 is separated from the intermediate transfer belt 31.

Figure 4:
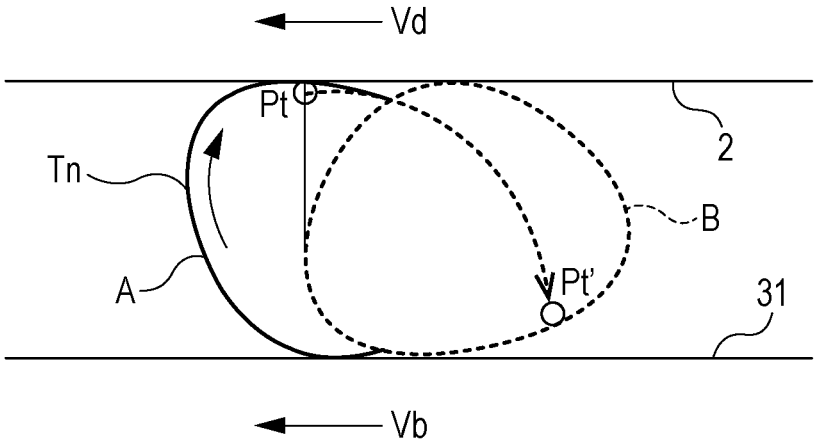
FIG. 4 is a schematic diagram illustrating the state of a toner in the primary transfer portion in the first embodiment.

Next, an increase in the transfer efficiency by increasing the nip width Ld will be described. FIG. 4 is a schematic diagram illustrating the state of the toner in the primary transfer portion N1. At the primary transfer portion N1, the photosensitive drum 2 is moving at a circumferential velocity Vd, and the intermediate transfer belt 31 is moving in the same direction as the moving direction of the photosensitive drum 2 at a circumferential velocity Vb. In the present embodiment, the circumferential velocity Vb is set to a value greater than the circumferential velocity Vd in such a manner that a speed difference ΔV ($\Delta V=|Vd-Vb|$) is given between the circumferential velocity Vd and the circumferential velocity Vb to increase the transfer performance at the primary transfer portion N1.

As illustrated in FIG. 4, of the toner image developed on the photosensitive drum 2 with the developing roller 51, the lowermost layer of toner adhering to the latent-image forming portion has a contact point Pt that contacts the photosensitive drum 2. In many cases, the toner having a point of contact with the photosensitive drum 2 adheres to the photosensitive drum 2 in stable condition by setting the contact point Pt as a point where adhesion of the surface of the toner to the photosensitive drum 2 is greater. The point on the surface of the toner where the adhesion force is great depends on the shape and the condition of the charge of the surface of the toner. The point where the adhesion to the photosensitive drum 2 is large tends to be difficult to move from the photosensitive drum 2 to the intermediate transfer belt 31 due to the large adhesion force. For that reason, increasing transfer efficiency for primarily transferring the toner whose contact point Pt is a point where adhesion to the photosensitive drum 2 is large requires a transfer condition for moving the toner to the intermediate transfer belt 31 at the primary transfer portion N1 with a force greater than the adhesion force.

In the configuration of the present embodiment, as illustrated in FIG. 4, when the toner Tn reaches the primary transfer portion N1, the toner Tn rotates like a bearing due to the speed difference ΔV at the primary transfer portion N1 to shift from state A to state B. With this movement, the contact point Pt between the toner Tn and the photosensitive drum 2 moves to a point Pt'. Thus, the contact point Pt having the large adhesion force, which was in contact with the photosensitive drum 2 before reaching the primary transfer portion N1, is separated from the photosensitive drum 2, so that the adhesion force of the toner Tn to the photosensitive drum 2 is decreased. The larger the nip width Ld, the more the contact point Pt is separated from the photosensitive drum 2, and thus the more the adhesive force between the toner Tn and the photosensitive drum 2 is reduced.

As described above, setting the nip width Ld between the photosensitive drum 2 and the intermediate transfer belt 31 large and giving the speed difference ΔV decrease the adhesion force between the toner Tn and the photosensitive drum 2, making it easy to take off the toner Tn from the photosensitive drum 2, increasing the transfer efficiency.

Figure 5A:
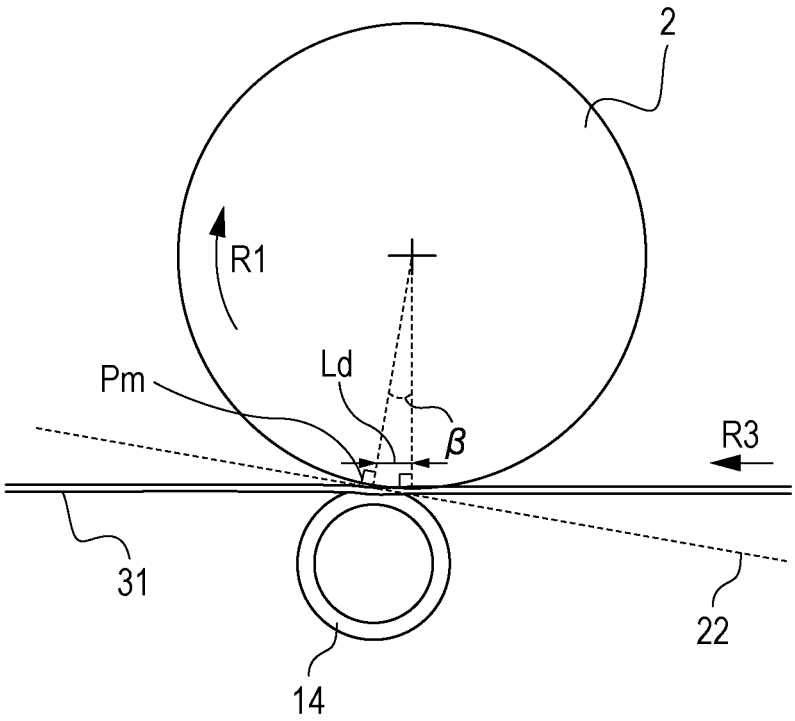
FIG. 5A is a schematic diagram illustrating a nip width at the primary transfer portion of the first embodiment.

FIG. 5A is a schematic diagram illustrating the nip width Ld at the primary transfer portion N1. The nip width Ld is formed by the elastic primary transfer roller 14 pressing the intermediate transfer belt 31, which is also an elastic member, against the rigid photosensitive drum 2. In FIG. 5A, a point Pm is an end of the primary transfer portion N1 in the direction in which the primary transfer roller 14 is shifted from the center of rotation of the photosensitive drum 2 (in the present embodiment, downstream in the moving direction of the intermediate transfer belt 31), that is, an end of the region where the nip width Ld is formed. A tangent line 22 is a tangent to the photosensitive drum 2 at the point Pm illustrated in phantom.

The intermediate transfer belt 31 is under the tension of a pressure spring (not illustrated). This causes a state in which the tension of the intermediate transfer belt 31 repels the urging force of the primary transfer roller 14. This forms, as illustrated in FIG. 5A, a region where the intermediate transfer belt 31 cannot be brought into contact with the photosensitive drum 2 by the primary transfer roller 14, that is, a region where the primary transfer roller 14 and the intermediate transfer belt 31 are in contact but the photosensitive drum 2 and the intermediate transfer belt are not in contact. In other words, the nip width Ld tends to be smaller than the region where the primary transfer roller 14 and the intermediate transfer belt 31 come into contact with each other.

Figure 5B:
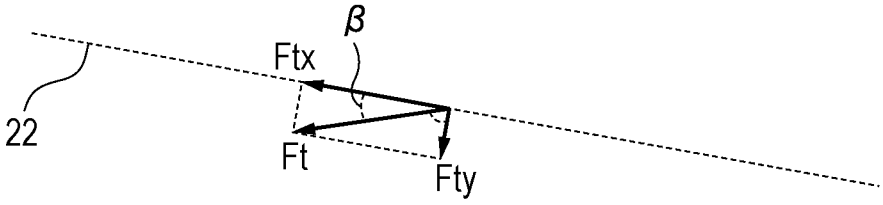
FIG. 5B is a schematic diagram illustrating a force applied to an end of the nip width.

FIG. 5B is a schematic diagram in which the tension force Ft of the intermediate transfer belt 31 acting on the point Pm, which is an end of the primary transfer portion N1, is resolved into a force Ftx in the direction of the tangent line 22 to the photosensitive drum 2 at the point Pm and a force Fty in the direction perpendicular to the tangent line 22. As illustrated in FIG. 5B, the perpendicular force Fty serves as one of forces of the intermediate transfer belt 31 under tension pressing the primary transfer roller 14. In contrast, the bending stress Fb (not illustrated) of the intermediate transfer belt 31 serves as an inhibitory force against the pressing force of the primary transfer roller 14 pressing the intermediate transfer belt 31 against the photosensitive drum 2. The pressing force Fr with which the primary transfer roller 14 pushes up the intermediate transfer belt 31 at the point Pm is expressed as Eq. 1.

$$Fr = Ft \cdot \sin\beta + Fb \quad \text{(Eq. 1)}$$

In other words, the portion where the pressing force Fr of the primary transfer roller 14 on the left side of Eq. 1 and the sum of the reactive forces on the right side balance each other is the point Pm, which is an end of the primary transfer portion N1. It is needless to say that if the right side is less than the left side in Eq. 1, the pressing force of the primary transfer roller 14 is greater than the inhibitory force to form the primary transfer portion N1. The pressing force Fr is also expressed as Eq. 2, where E is the Young's modulus of the rubber of the primary transfer roller 14, and E is the strain of the primary transfer roller 14.

$$Fr = E \cdot \varepsilon \quad \text{(Eq. 2)}$$

As expressed by Eq. 1 and Eq. 2, since the pressing force Fr is decreased as the value E of the Young's modulus of the primary transfer roller 14 decreases, it is necessary to decrease the angle β in FIG. 5A in order to balance the left side and the right side of Eq. 1. In this case, the nip width Ld is decreased. In other words, a decrease in the hardness of the primary transfer roller 14 decreases the nip width Ld.

Hardness and Thickness of Elastic Layer

The possible ranges of the hardness of the primary transfer roller 14 and the thickness of the elastic layer 21 found by an experiment will be described.

The hardness of the primary transfer roller was measured using an Asker-C hardness meter by applying a weight of 1 kg including the own weight of the hardness meter to the primary transfer roller including the core metal. In this measurement, the core metal serves as a support for the elastic layer, so that the value of the Asker-C hardness obtained by measuring the hardness of the primary transfer roller can be substantially regarded as the hardness of the elastic layer. In other words, the hardness of the elastic layer can be measured by pressing the reader of the hardness meter against the primary transfer roller toward the center of the core metal from immediately above in the vertical direction. In the following description, the hardness of the primary transfer roller obtained by measuring the primary transfer roller is used as the hardness of the elastic layer. The value of the hardness of the elastic layer increases as the hardness of the base rubber material increases, and decreases as the hardness of the base material decreases. The value increases as the thickness of the elastic layer decreases, and decreases as the thickness of the elastic layer increases.

To decrease the influence of an error, the hardness of the elastic layer was measured at multiple portions by the above measuring method, and the measured values were averaged. More specifically, the hardness of the elastic layer was measured at three points at the longitudinal center and at opposite ends of the primary transfer roller in the longitudinal direction four times at intervals of 90 degrees in the direction of rotation of the primary transfer roller, that is, three points in the longitudinal direction×four points in the rotating direction=12 points in total, and the average of the measured values was obtained.

Nip Width Ld of Primary Transfer Portion N1

Figure 6:
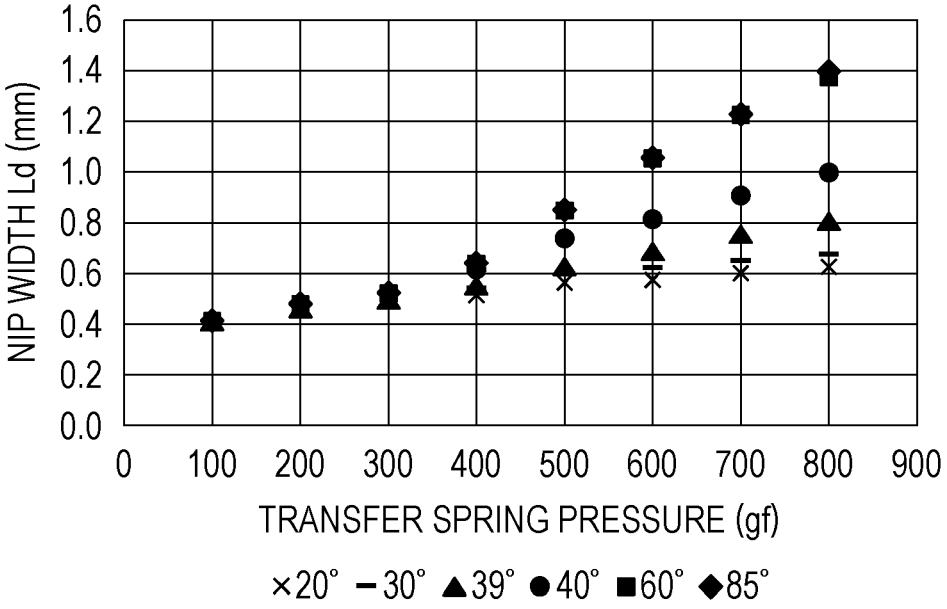
FIG. 6 is a graph illustrating the relationship between the hardness of the primary transfer member and the nip width.

Next, the nip width Ld was measured, at different pressures of the pressure springs, for primary transfer rollers with different degrees of hardness obtained in the above measurement. The nip width Ld was measured by bringing the intermediate transfer belt 31 into and out of contact with the photosensitive drum 2, with a color material, such as toner, placed on the intermediate transfer belt 31 and measuring the width of the color material transferred onto the photosensitive drum 2. FIG. 6 is a graph illustrating the relationship between the primary transfer roller and the nip width Ld. As illustrated in FIG. 6, the higher the Asker-C hardness (with a load of 1 kgf) of the primary transfer roller, the larger the increase in the nip width Ld due to an increase in the pressure of the pressure springs. In contrast, the nip width Ld of primary transfer rollers with an Asker-C hardness (under a load of 1 kgf) of less than 40° did not increase even if the pressure of the pressure springs was increased.

Evaluation of Transfer Efficiency

Next, the transfer efficiency of primary transfer rollers with different degrees of hardness was evaluated under the condition that the pressure of the transfer springs is 500 gf. The transfer efficiency was evaluated under the condition that the ratio of speed difference, Vr, defined by Eq. 3 is 0.2%.

$$\text{Ratio of speed difference } Vr = |Vd - Vb| / Vd \quad \text{(Eq. 3)}$$

For minute evaluation, in an image forming unit Sb for forming a magenta (M) toner image, an image whose toner concentration relative to a transfer material P is 100% (hereinafter simply referred to as "solid image") was primarily transferred from the photosensitive drum 2*b* to the intermediate transfer belt 31. Thereafter, in the image forming unit Sc disposes downstream from the image forming unit Sb in the moving direction of the intermediate transfer belt 31, a solid image was primarily transferred from the photosensitive drum 2*c* to the intermediate transfer belt 31. The toner remaining on the surface of the photosensitive drum 2*c* after the solid image was primarily transferred was taken by taping, and the reflectivity of the remaining toner was measured using a reflection densitometer TC-6DS (manufactured by Tokyo Denshoku).

In the evaluation, the reflectivity was round up to whole numbers. A reflectivity of 4% or lower was rated as "Excellent", a reflectivity of higher than 4% and 8% or lower was rated as "good", a reflectivity of higher than 8% and 12% or lower was rated as "average", and a reflectivity of higher than 12% was rated as "poor". In the various configurations of the present embodiment, a reflectivity of 8% or lower is a level at which a uniform, good two-color solid image can be formed on the intermediate transfer belt 31. In contrast, a reflectivity of higher than 8% and 12% or lower is a level at which a good one-color solid image can be formed but a two-color solid image can be uneven in concentration. A reflectivity of 12% or higher is a level at which unevenness in concentration will obviously occur in a two-color solid image. The results are shown on Table 1.

TABLE 1

| | Asker-C hardness | | | | | |
|---|---|---|---|---|---|---|
| | 20° | 30° | 39° | 40° | 60° | 85° |
| Drum nip width Ld(mm) | 0.58 | 0.6 | 0.65 | 0.75 | 0.85 | 0.85 |
| Transfer residual concentration | 13.5 (Poor) | 10.8 (Average) | 10.2 (Average) | 7.8 (Good) | 6.7 (Good) | 6.7 (Good) |

As shown on Table 1, the primary transfer rollers with an Asker-C hardness of 40° or high obtained high transfer efficiency of a reflectivity of 8% or lower. The primary transfer rollers with an Asker-C hardness of 30° or lower had a difference in transfer efficiency in the widthwise direction (the longitudinal direction) of the primary transfer roller perpendicular to the moving direction of the intermediate transfer belt 31. This is because, a small nip width Ld increases the influence of the longitudinal variations of the nip width Ld due to a difference in the mount position of the primary transfer roller or the pressure of the transfer springs in the longitudinal direction. A nip width Ld larger than 0.65 mm offered stable transfer efficiency in the longitudinal direction.

Figure 7:
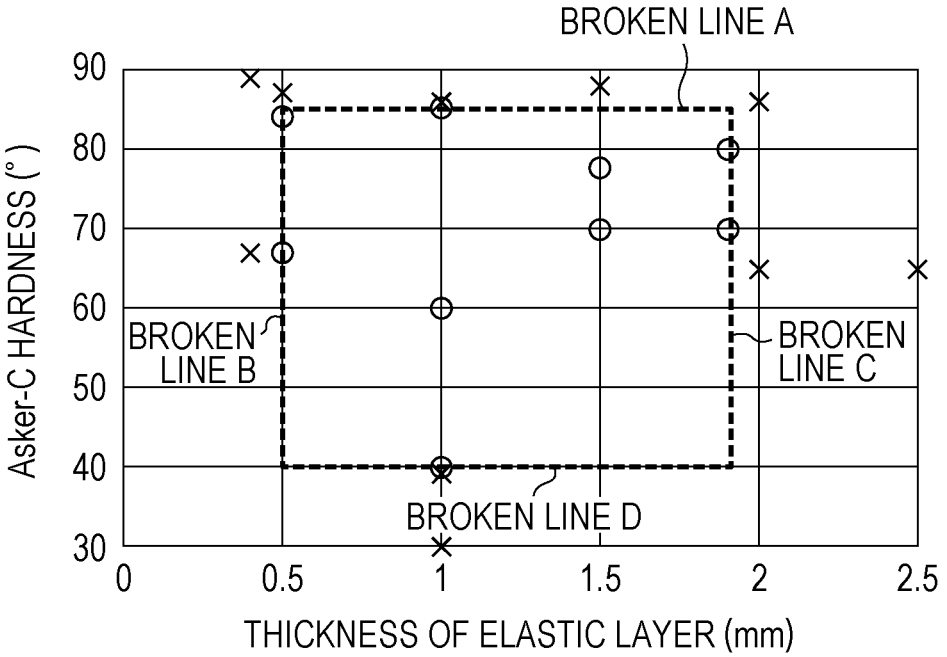
FIG. 7 is a graph illustrating the relationship between the hardness of the primary transfer member and the thickness of the elastic layer.

Next, the result of a study of the possible range of the thickness of the elastic layer 21 of the primary transfer roller 14 will be described. FIG. 7 is a diagram illustrating the result. Symbols o and x in FIG. 7 represent whether an image defect has occurred in the configurations of individual primary transfer rollers, in which o represents a configuration in which no image defect has occurred, and x represents a configuration in which an image defect has occurred. As illustrated in FIG. 7, the study in the present embodiment shows that an image defect occurred in the region whose Asker-C hardness is higher than a broken line A, and also in the region whose Asker-C hardness is lower than a broken line D. An image defect was found in the region in which the thickness of the elastic layer 21 is smaller than a broken line B and also in the region in which the thickness of the elastic layer 21 is larger than the broken line C.

Continuous use of the image forming apparatus 100 can cause foreign substances, such as dust, entering from the outside of the image forming apparatus 100 or foreign substances that have dropped in the image forming apparatus 100 to adhere to the primary transfer roller 14 and the intermediate transfer belt 31. In such a case, if the foreign substances reach the contact position between the primary transfer roller 14 and the intermediate transfer belt 31 while the primary transfer roller 14 is rotating with the movement of the intermediate transfer belt 31, an image defect due to the foreign substances can occur. More specifically, the foreign substances serve as spacers between the intermediate transfer belt 31 and the primary transfer roller 14, so that the surface property of the intermediate transfer belt 31 at the position to which the foreign substances adhere may change to cause an image defect due to the foreign substances.

The higher the hardness of the base rubber material or the smaller the thickness of the elastic layer 21, the more the image defect due to foreign substances can occur. In other words, the higher the Asker-C hardness obtained by measuring the primary transfer roller 14 (the hardness of the elastic layer 21), the more the image defect due to foreign substances tends to occur.

A study in the present embodiment in which an image forming operation was executed, with foreign substances of 200 μm attached to the primary transfer roller 14, shows that an image defect due to the foreign substances occurred in a configuration in which primary transfer rollers 14 whose Asker-C hardness is larger than 85°, illustrated in FIG. 7, are used. The broken line A in FIG. 7 indicates a boundary for Asker-C hardness for the occurrence of an image defect due to foreign substances. Therefore, in order to reduce the occurrence of an image defect due to foreign substances, it is preferable to use a primary transfer roller 14 in which the Asker-C hardness obtained by measuring the primary transfer roller 14 (the hardness of the elastic layer 21) is 85° or lower.

When the thickness is smaller than 0.5 mm, an image defect due to foreign substances occurred, as described above. The broken line B in FIG. 7 indicates a boundary for the thickness of the elastic layer 21 for the occurrence of an image defect due to foreign substances. This may be because a sufficient thickness of the elastic layer 21 for coping with foreign substances entering the primary transfer portion cannot be provided, so that the foreign substances serve as spacers between the intermediate transfer belt 31 and the primary transfer roller 14, causing an image defect due to the foreign substances. Therefore, in order to reduce the occurrence of an image defect due to foreign substances, a primary transfer roller 14 in which the thickness of the elastic layer 21 is 0.5 mm or more, in addition to the requirement for the Asker-C hardness, may be used.

As illustrated in FIG. 7, when the thickness exceeds 2.0 mm, an image defect not due to foreign substances occurred regardless of the Asker-C hardness. This image defect occurs because an increase in the outside diameter of the primary transfer roller 14 causes the nip width Ld of the primary transfer portion N1 to increase upstream in the moving direction of the intermediate transfer belt 31. More specifically, when the nip width Ld increases upstream in the moving direction of the intermediate transfer belt 31, the position at which a toner image borne on the photosensitive drum 2 is transferred to the intermediate transfer belt 31 is shifted upstream in the moving direction of the intermediate transfer belt 31 to cause an image defect.

Figure 8:
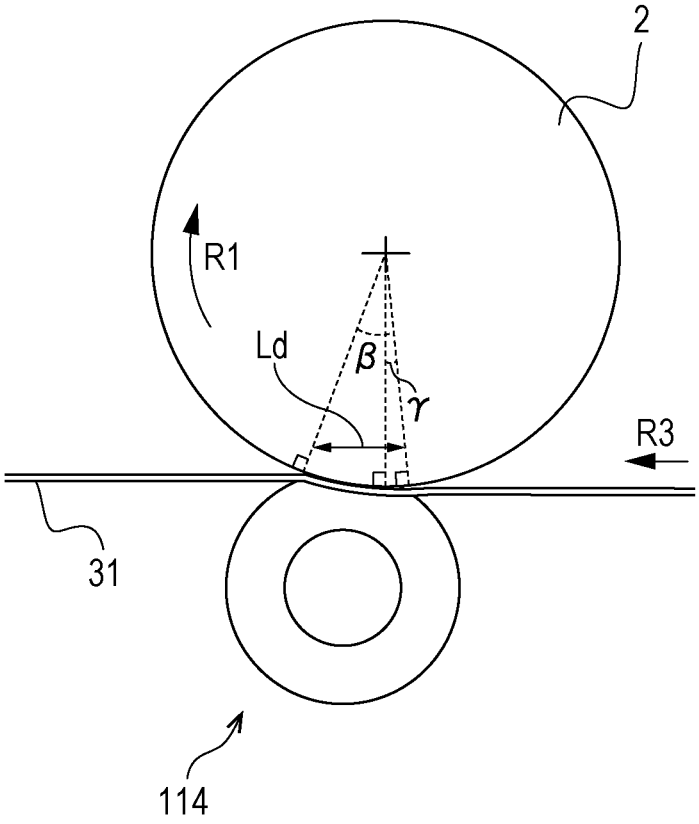
FIG. 8 is a schematic diagram illustrating the relationship between the thickness of the elastic layer and the nip width of a primary transfer member of a comparative example.

FIG. 8 is a schematic diagram illustrating a nip width Ld formed when a primary transfer roller 114 of a comparative example is used. The primary transfer roller 114 of the comparative example has a configuration in which the thickness of the elastic layer is larger than 2.0 mm. As illustrated in FIG. 8, since the primary transfer roller 114 has a large outside diameter, the position at which the nip width Ld in the moving direction of the intermediate transfer belt 31 is formed expands upstream from the central position of the photosensitive drum 2 by an amount of tan γ×the radius (mm) of the photosensitive drum 2. This causes the toner to splash from the photosensitive drum 2 onto the intermediate transfer belt 31 at a position upstream from a predetermined transfer position, so that the toner image formed on the intermediate transfer belt 31 after the primary transfer is sparsely disposed. This causes degradation of character quality, forming an image defect. In this experiment, an elastic layer 21 having a thickness of 1.9 mm or less did not cause degradation of character quality, providing a high primary transfer performance. The broken line C in FIG. 7 indicates a boundary for the thickness of the elastic layer 21 for the occurrence of an image defect due to an increase in the nip width Ld, as described above. Accordingly, the thickness of the elastic layer 21 may be set to less than 2.0 mm, as indicated by the broken line C.

When the Asker-C hardness of the primary transfer roller, which corresponds to the hardness of the elastic layer 21, is 40° or higher, high transfer efficiency was given, as described in the transfer efficiency evaluation result. The broken line D in FIG. 7 indicates a boundary for Asker-C hardness for high transfer efficiency.

As described above, when the Asker-C hardness of the primary transfer roller 14 is 40° or high and 85° or lower, high transfer efficiency is given, and also the occurrence of an image defect due to foreign substances can be reduced. Setting the thickness of the elastic layer 21 to 0.5 mm or more and less than 2.0 mm allows reducing the occurrence of an image defect due to foreign substances and an image defect due to an excessive increase in the nip width Ld.

Although the present embodiment illustrates a configuration in which the ratio of speed difference, Vr, is set to 0.2%, this is given for mere illustrative purposes. However, excessive radio of speed difference Vr can excessively increase the moving amount of the toner Tn nipped at the primary transfer portion N1. In this case, the image expands in the moving direction of the intermediate transfer belt 31 to cause a possible image defect. In the configuration of the present embodiment, when the ratio of speed difference Vr exceeds 3%, an image of a mincho 6-pt single-color black letter "電" expanded. For that reason, the upper limit of the ratio of speed difference Vr is preferably set to 3% from the viewpoint of maintaining the character quality.

The elastic layer 21 may have a solid structure or a hollow structure, like sponge, provided that the Asker-C hardness is set within the range from 40° or higher and 85° or lower. The elastic layer 21 may have a straight form having the same thickness in the longitudinal direction or a crown shape in which the central region is thicker than the opposite end regions. The pressure at the longitudinal center may be decreased because of the relationship among the hardness of the elastic layer 21, the pressure of the transfer springs, and the longitudinal width of the primary transfer roller 14, so that the transfer efficiency at the center can be lower than that at the ends. In this case, setting the thickness of the elastic layer 21 larger at the center than at the ends in the longitudinal direction allows the nip width Ld to be kept uniform, providing stable transfer efficiency.

Although the present embodiment illustrates the image forming apparatus 100 of an intermediate transfer system using the intermediate transfer belt 31, the present invention is not limited thereto. Also an image forming apparatus of a direct transfer system using a conveying belt that conveys transfer materials P may provide advantageous effects similar to those of the present embodiment by using the primary transfer roller 14 described in the present embodiment.

Second Embodiment

The first embodiment illustrates the hardness of the primary transfer roller 14, or the hardness of the elastic layer 21, and the thickness of the elastic layer 2 as a configuration for securing sufficient transfer efficiency. In contrast, the second embodiment differs from the first embodiment in that sufficient transfer efficiency is secured by defining the hardness of the primary transfer roller 14, or the hardness of the elastic layer 21, and the ratio of speed difference Yr. In the following description, the same components as those of the first embodiment are denoted by the same reference signs, and descriptions thereof will be omitted.

As illustrated in FIG. 4, the toner Tn comes farther away from the contact point Pt with the photosensitive drum 2 by increasing the ratio of speed difference Vr, so that the adhesive force between the toner Tn and the photosensitive drum 2 is decreased. This may be because increasing the ratio of speed difference Vr provides a sufficient distance between the initial contact point of the toner Tn with the photosensitive drum 2 and the photosensitive drum 2 for decreasing the adhesive force, thereby further increasing the transfer efficiency. With the above mechanism, by increasing the ratio of speed difference Vr, advantageous effects equivalent to those obtained by increasing the width of the primary transfer portion N1 are obtained. Accordingly, even the primary transfer rollers 14 with an Asker-C hardness of 39° or lower, which could not obtain high transfer efficiency in the first embodiment, can obtain high transfer efficiency by setting the ratio of speed difference Vr to a predetermined value or greater.

Examples of a method for providing the speed difference ΔV include a method of sharing a driving system between the photosensitive drum 2 and the intermediate transfer belt 31 to mechanically provide the speed difference ΔV using a gear ratio and a method of providing a driving system for each of the photosensitive drum 2 and the intermediate transfer belt 31 to provide the speed difference ΔV. The latter method has a higher degree of flexibility of varying the speed difference ΔV than the former method. The speed difference ΔV between the photosensitive drum 2 and the intermediate transfer belt 31 can be obtained by comparing the surface velocity of the photosensitive drum 2 and the surface velocity of the intermediate transfer belt 31 measured by a laser Doppler velocimeter or the like.

The transfer efficiency was evaluated at different ratios of speed difference Yr. Since the method for evaluating the transfer efficiency is the same as the method of the first embodiment, a description thereof will be omitted. Table 2 shows the results of evaluation of transfer efficiency of primary transfer rollers 14 with different values of Asker-C hardness at different ratios of speed difference Yr.

TABLE 2

| | | Asker-C hardness | | | | | |
|---|---|---|---|---|---|---|---|
| | | 37° | 38° | 39° | 40° | 60° | 85° |
| | | Nip width Ld(mm) | | | | | |
| | | 0.64 | 0.65 | 0.65 | 0.75 | 0.85 | 0.85 |
| Ratio of speed difference Vr | 0.2% | Longitudinally nonuniform | 10.4 (Average) | 10.2 (Average) | 7.8 (Good) | 6.7 (Good) | 6.7 (Good) |
| | 0.5% | | 9.2 (Average) | 9.2 (Average) | 6.4 (Good) | 6.3 (Good) | 6.3 (Good) |
| | 1.0% | | 8.3 (Average) | 8.2 (Average) | 5.8 (Good) | 5.7 (Good) | 5.7 (Good) |
| | 1.5% | | 7.2 (Good) | 7.1 (Good) | 5.3 (Good) | 5.1 (Good) | 5.1 (Good) |
| | 2.0% | | 6.3 (Good) | 6.1 (Good) | 4.7 v | 4.4 (Good) | 4.4 (Good) |
| | 2.5% | | 5.3 (Good) | 5.1 (Good) | 4.2 (Good) | 3.8 (Great) | 3.8 (Great) |
| | 3.0% | | 4.2 (Good) | 4.1 (Good) | 3.6 (Great) | 3.2 (Great) | 3.2 (Great) |

As shown in Table 2, the higher the ratio of speed difference Vr, the higher transfer efficiency was obtained. More specifically, with a configuration in which the Asker-C hardness of the elastic layer 21 is 40° and the ratio of speed difference Vr is 3.0% and a configuration in which the Asker-C hardness is 60° or high and the ratio of speed difference Vr is 2.5% or higher, the reflectivity was 4% or lower, so that high transfer efficiency could be obtained. With a configuration in which the Asker-C hardness of the elastic layer 21 is 38° and a configuration in which the Asker-C hardness is 39°, high transfer efficiency could be obtained by setting the ratio of speed difference Vr to 1.5% or higher. In contrast, with a configuration in which the Asker-C hardness of the elastic layer 21 is 37° or lower, the nip width Ld was less than 0.65 mm, so that the transfer efficiency was nonuniform in the longitudinal direction of the primary transfer roller 14.

As shown in Table 2, higher transfer efficiency is given as the ratio of speed difference Vr is increased. However, excessive radio of speed difference Vr can excessively increase the moving amount of the toner Tn nipped at the primary transfer portion N1. In this case, the image expands in the moving direction of the intermediate transfer belt 31 to cause a possible image defect. In the configuration of the present embodiment, when the ratio of speed difference Vr exceeds 3%, an image of a mincho 6-pt single-color black letter "雷" expanded. For that reason, the upper limit of the ratio of speed difference Vr is preferably set to 3% from the viewpoint of maintaining the character quality.

As described above, the present embodiment provides high transfer efficiency by setting the ratio of speed difference Vr to 1.5% or higher and 3.0% or lower and by setting the Asker-C hardness of the primary transfer roller 14, which is the hardness of the elastic layer 21, to 38° or higher and 85° or lower.

The elastic layer 21 may have a solid structure or a hollow structure, like sponge, provided that the Asker-C hardness is set within the range from 38° or higher and 85° or lower. The elastic layer 21 may have a straight form having the same thickness in the longitudinal direction or a crown shape in which the central region is thicker than the opposite end regions. The pressure at the longitudinal center may be decreased because of the relationship among the hardness of the elastic layer 21, the pressure of the transfer springs, and the longitudinal width of the primary transfer roller 14, so that the transfer efficiency at the center can be lower than that at the ends. In this case, setting the thickness of the elastic layer 21 larger at the center than at the ends in the longitudinal direction allows the nip width Ld to be kept uniform, providing stable transfer efficiency.

Although the present embodiment illustrates the image forming apparatus 100 of an intermediate transfer system using the intermediate transfer belt 31, the present invention is not limited thereto. Also an image forming apparatus of a direct transfer system using a conveying belt that conveys transfer materials P may provide advantageous effects similar to those of the present embodiment by using the primary transfer roller 14 described in the present embodiment.

Third Embodiment

The first embodiment illustrates a configuration in which a region in which the primary transfer roller 14 and the intermediate transfer belt 31 come into contact and a region in which the photosensitive drum 2 and the intermediate transfer belt 31 come into contact overlap with each other. In contrast, the third embodiment differs from the first embodiment in the position of the primary transfer roller 14. In the following description, the same components as those of the first embodiment are denoted by the same reference signs, and descriptions thereof will be omitted.

Configuration of Primary Transfer Portion

Figure 9A:
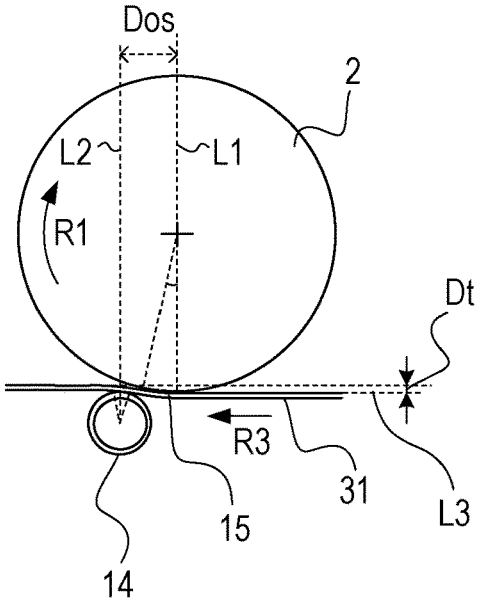
FIGS. 9A and 9B are schematic enlarged cross-sectional views of a primary transfer portion in a third embodiment.
Figure 9B:
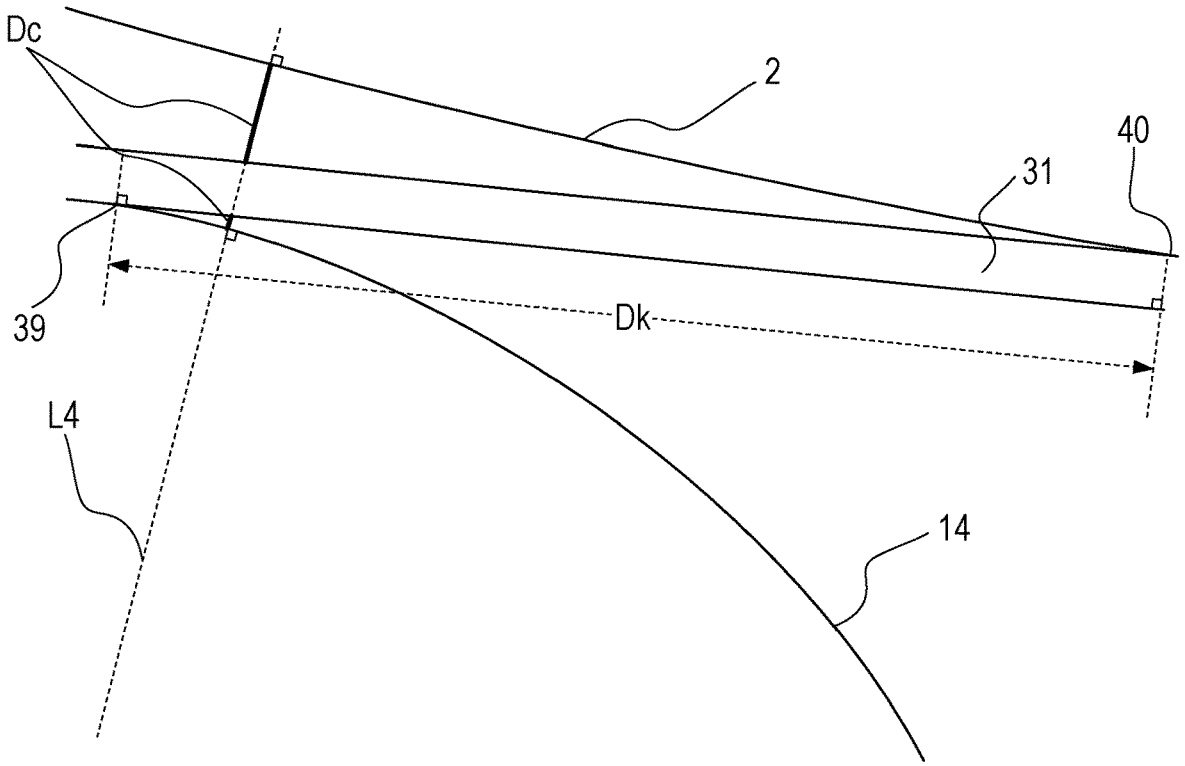

FIG. 9A is a schematic enlarged cross-sectional view of the primary transfer portion N1 in the present embodiment. FIG. 9B is a further enlarged schematic cross-sectional view of the primary transfer portion N1 of FIG. 9A. An imaginary line L1 in FIG. 9A is a perpendicular drawn from the center of rotation of the photosensitive drum 2 to the intermediate transfer belt 31. An imaginary line L2 is a perpendicular drawn from the center of rotation of the primary transfer roller 14 to the intermediate transfer belt 31. An imaginary line L3 in FIG. 9A is a tangent to the photosensitive drum 2 at a position at which the perpendicular L1 and the intermediate transfer belt 31 intersect each other. In the configuration of the present embodiment, the diameter of the photosensitive drum 2 is 24 mm, and the thickness of the intermediate transfer belt 31 is 70 μm.

As illustrated in FIG. 9A, the primary transfer roller 14 of the present embodiment is disposed downstream from the center of rotation of the photosensitive drum 2 in the moving direction of the intermediate transfer belt 31 as viewed from the rotation axis of the photosensitive drum 2. The distance $D_{OS}$ between the imaginary line L1 and the imaginary line L2 is hereinafter defined as the offset amount of the primary transfer roller 14 with respect to the photosensitive drum 2. Since the configuration of the primary transfer roller 14 in the present embodiment is the same as the configuration in the first embodiment, a description thereof will be omitted.

As illustrated in FIG. 9A, the primary transfer roller 14 of the present embodiment is disposed in a state of being urged by a predetermined urging force so as to enter the photosensitive drum 2 by an intrusion amount Dt (about 0.1 mm) with respect to the imaginary line L3. Since the primary transfer roller 14 is disposed at the intrusion amount Dt, the intermediate transfer belt 31 comes into contact with the photosensitive drum 2 while winding therearound. The intermediate transfer belt 31 also comes into contact with the primary transfer roller 14 while winding therearound.

As illustrated in FIG. 9B, the primary transfer roller 14 is disposed (offset) downstream from the photosensitive drum 2 in the moving direction of the intermediate transfer belt 31, so that a stretched surface of the intermediate transfer belt 31 is formed between the photosensitive drum 2 and the primary transfer roller 14. The distance between a contact point 40 between the photosensitive drum 2 and the intermediate transfer belt 31 and a contact point 39 between the primary transfer roller 14 and the intermediate transfer belt 31 is defined as a stretch distance Dk. A straight line L4 in FIG. 9B is a straight line connecting the center of rotation of the photosensitive drum 2 and the center of rotation of the primary transfer roller 14. In the present embodiment, the total of the distance between the photosensitive drum 2 and the intermediate transfer belt 31 and the distance between the primary transfer roller 14 and the intermediate transfer belt 31 on the straight line L4 is defined as a primary transfer clearance (hereinafter referred to as "clearance") Dc.

Setting Offset Amount of Primary Transfer Roller

Figure 10A:
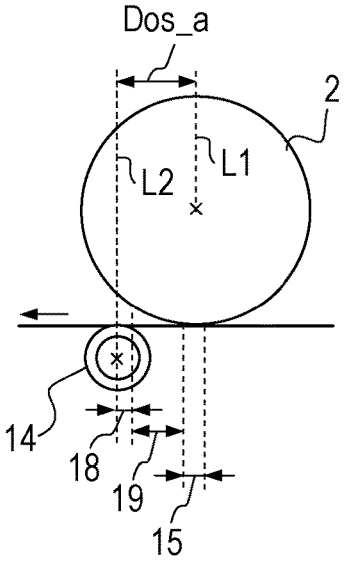
FIGS. 10A to 10C are schematic diagrams illustrating the arrangement of the components at different offset amounts between the image bearing member and the primary transfer member of the third embodiment.
Figure 10B:
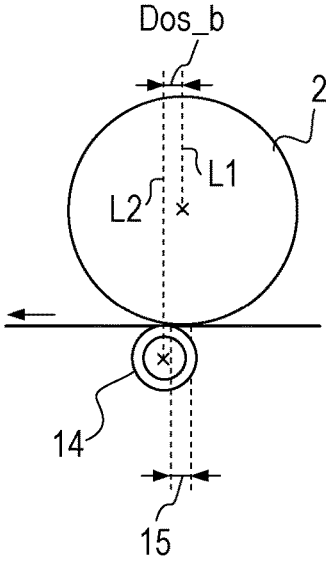
Figure 10C:
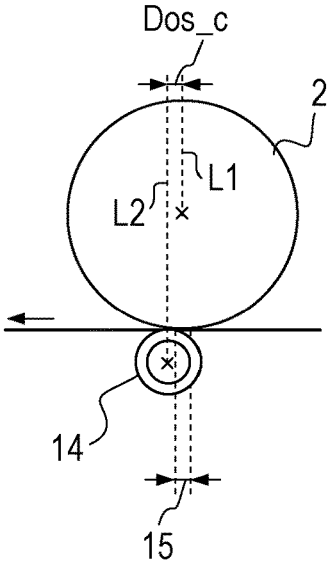
Figure 11A:
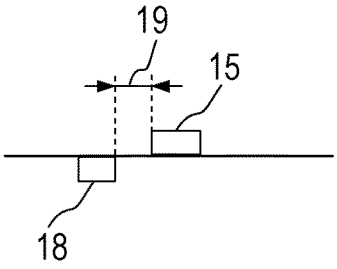
FIGS. 11A to 11C are schematic diagrams illustrating the relationship between a region where the belt and the image bearing member come into contact and a region where the belt and the primary transfer member come into contact at different offset amounts between the image bearing member and the primary transfer member of the third embodiment.
Figure 11B:
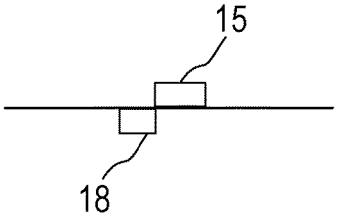
Figure 11C:
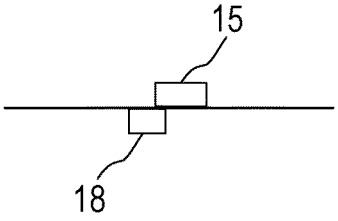

FIGS. 10A to 10C are schematic diagrams illustrating the arrangement of the components at different offset amounts (distance $D_{OS}$) between the photosensitive drum 2 and the primary transfer roller 14. FIGS. 11A to 11C are schematic diagrams corresponding to FIGS. 10A to 10C, respectively, for comparing the positional relationship between a region 15 at which the photosensitive drum 2 and the intermediate transfer belt 31 come into contact and a region 18 at which the primary transfer roller 14 and the intermediate transfer belt 31 come into contact. In FIGS. 10A to 10C and FIGS. 11A to 11C, the intermediate transfer belt 31 is schematically expressed as a straight line. However, the primary transfer roller 14 is actually disposed in a state of entering the intermediate transfer belt 31 toward the photosensitive drum 2 by an intrusion amount Dt, as illustrated in FIG. 9A.

In FIGS. 10A, 10B, and 10C, the distance $D_{OS}$, which is the offset amount between the photosensitive drum 2 and the primary transfer roller 14, is varied. The relationship among a distance $D_{OS}$_a in the arrangement of FIG. 10A, a distance $D_{OS}$_b in the arrangement of FIG. 10B, and a distance $D_{OS}$_c in the arrangement of FIG. 10C satisfies Eq. 1.

$$D_{OS_a} > D_{OS_b} > D_{OS_c} \quad \text{(Eq. 1)}$$

As illustrated in FIG. 11A, in the arrangement of FIG. 10A, a distance 19 is present between the region 15 and the region 18. The distance 19 substantially corresponds the stretch distance Dk described above. In other words, in the arrangement of FIG. 10A, a stretch surface is formed between the photosensitive drum 2 and the primary transfer roller 14 in the moving direction of the intermediate transfer belt 31.

In contrast, in the arrangement of FIG. 10B, the region 15 and the region 18 are next to each other, as illustrated in FIG. 11B. In other words, the photosensitive drum 2 and the primary transfer roller 14 are disposed so that a downstream end of the region 15 and an upstream end of the region 18 are next to each other in the moving direction of the intermediate transfer belt 31, so that the stretch distance Dk is zero in the configuration of FIG. 10B. In the arrangement of FIG. 10C, the region 15 and the region 18 are overlapped with each other (hereinafter the region in which the region 15 and the region 18 overlap is referred to as "physical nip portion"), as illustrated in FIG. 11C. Accordingly, in the arrangements of FIG. 10B and FIG. 10C, the stretch surface as in FIG. 10A is not formed.

In the arrangement of FIG. 10A, when a toner image is transferred from the photosensitive drum 2 to the intermediate transfer belt 31, a transfer current flows from the primary transfer roller 14 toward the photosensitive drum 2 in the moving direction of the intermediate transfer belt 31. For that reason, the surface resistance of the intermediate transfer belt 31 affects the impedance during primary transfer. In contrast, in the arrangement of FIG. 10C, the current flowing from the primary transfer roller 14 toward the photosensitive drum 2 flows in the thickness direction of the intermediate transfer belt 31 at the physical nip portion. For that reason, the volume resistance of the intermediate transfer belt 31 affects the impedance during primary transfer.

Since the impedance during primary transfer changes depending on whether the physical nip portion is present, as described above, it is undesirable that the arrangements of FIG. 10A and FIG. 10C are mixed within the range of use of the image forming apparatus and the tolerance zone of the configuration and arrangement of the components. For that reason, in the present embodiment, the primary transfer roller 14 is disposed so that the arrangement of FIG. 10A is maintained, that is, so that the clearance Dc in FIG. 9B is larger than 0 mm within the range of use of the image forming apparatus 100 and the tolerance zone of the configuration and arrangement of the components. The arrangement in which the clearance Dc in FIG. 9B is 0 mm corresponds to the arrangement of FIG. 10B. The position of the primary transfer roller 14 at which the clearance Dc is larger than 0 mm corresponds to a position at which the primary transfer roller 14 does not press the photosensitive drum 2 via the intermediate transfer belt 31, which will be described in detail hereinbelow.

Figure 12:
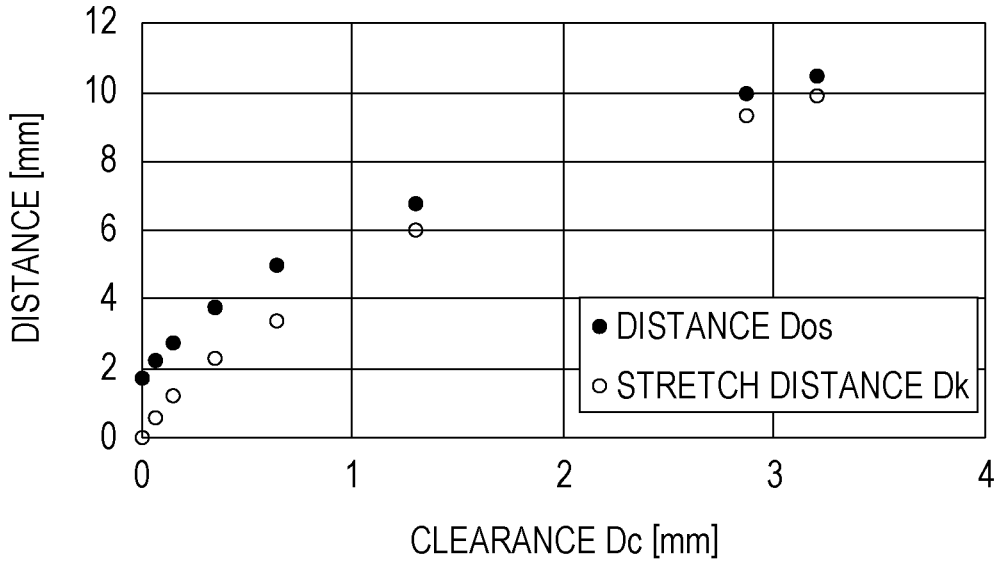
FIG. 12 is a graph illustrating the relationship between the offset amount and the stretch distance in the third embodiment.

FIG. 12 is a graph illustrating the relationship among the clearance Dc, the distance $D_{OS}$, which is offset amount, and the stretch distance Dk. As illustrated in FIG. 12, in the configuration of the present embodiment, the stretch distance Dk is 0 mm, and the distance $D_{OS}$ is 1.76 mm in the state of FIG. 10B in which the clearance Dc is 0 mm. In other words, the graph of FIG. 12 shows that setting the distance $D_{OS}$ larger than 1.76 mm allows maintaining the clearance Dc and the stretch distance Dk in predetermined ranges in the configuration of the present embodiment. Therefore, under the conditions of the present embodiment, the arrangement of FIG. 10A can be maintained by disposing the primary transfer roller 14 so that the distance $D_{OS}$ does not fall below 1.76 mm.

Figure 13:
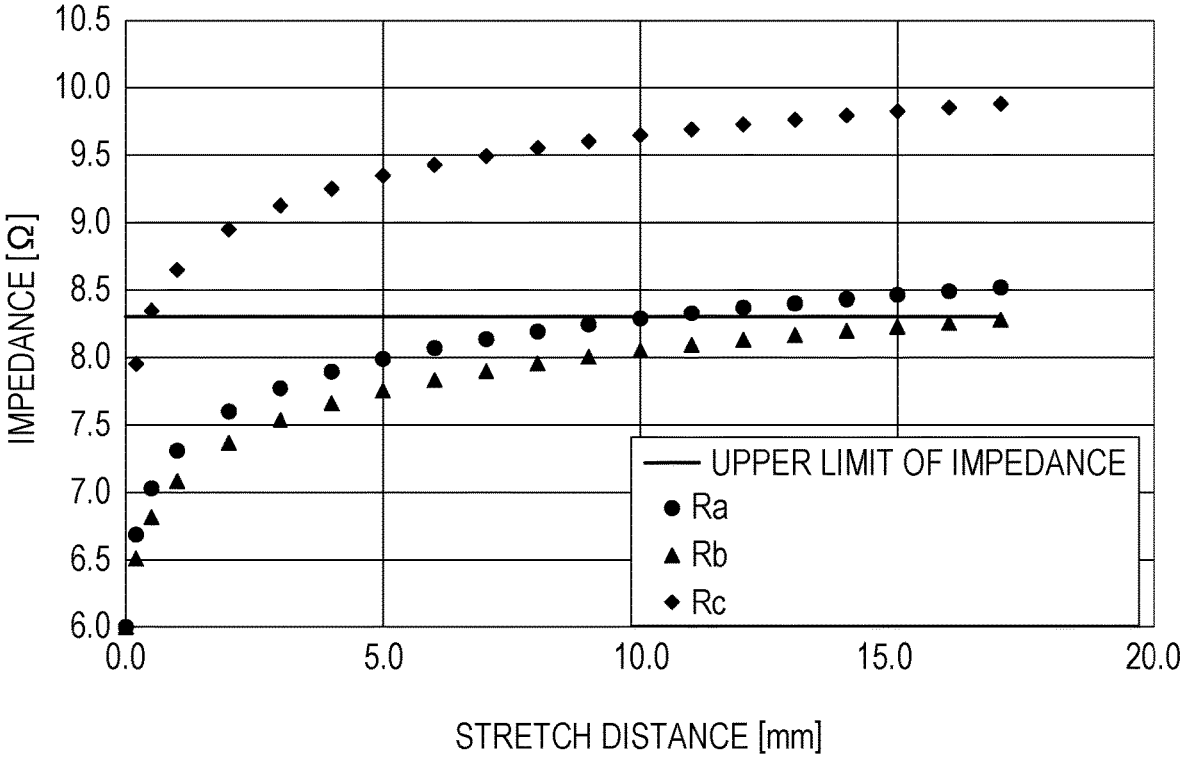
FIG. 13 is a graph illustrating the relationship between the stretch distance and the impedance during primary transfer in the third embodiment.

Having described the lower limit of the distance $D_{OS}$, it is more preferable to set the distance $D_{OS}$, or the offset amount, to 10 mm or less. This will be described in detail with reference to the graph of FIG. 13. FIG. 13 is a graph illustrating the relationship between the stretch distance Dk and the impedance (the impedance during primary transfer) between the primary transfer roller 14 and the photosensitive drum 2 in the moving direction of the intermediate transfer belt 31. Symbols Ra to Rc in the graph of FIG. 13 are obtained on the basis of three levels of surface resistivity of the intermediate transfer belt 31 in the present embodiment, the electrical resistance of the elastic layer 21 (about 6 log pi), and the stretch distance Dk. The surface resistivity of the intermediate transfer belt 31 corresponding to Ra is 9.64 [Ω/sq.], the surface resistivity of the intermediate transfer belt 31 corresponding to Rb is 9.40 [Ω/sq.], and the surface resistivity of the intermediate transfer belt 31 corresponding to Rc is 11.0 log [Ω/sq.]. The following description is made using the values corresponding to Ra.

As illustrated in FIG. 13, the larger the stretch distance Dk, the larger the impedance during primary transfer is. More specifically, in the configuration in which the stretch distance Dk is 9.9 mm, the distance $D_{OS}$ (offset amount) is 10.5 mm, and the impedance during primary transfer is 8.3 log [Ω]. If a primary transfer current necessary for executing correct primary transfer processing is about 15 μA, it is necessary to apply a voltage of about 3.0 kV to the primary transfer roller 14 because the impedance during primary transfer is high in the configuration in which the stretch distance Dk is 9.9 mm.

With the configuration of the present embodiment, if the value of the voltage applied to the primary transfer roller 14 exceeds 3.0 kV, the risk of abnormal electrical discharge between the primary transfer roller 14 and the photosensitive drum 2 increases, which may decrease the transfer performance to cause an image defect. Accordingly, in the configuration of the present embodiment, it is more preferable to set the distance $D_{OS}$ (offset amount) to 10 mm or less so as not to apply an excessive voltage to the primary transfer roller 14 during primary transfer. Setting the distance $D_{OS}$ (offset amount) to 10 mm or less also allows preventing an increase in the size and cost of the power source due to higher power voltage output for securing a sufficient voltage to be applied to the primary transfer roller 14.

For that reason, in the present embodiment, the distance $D_{OS}$ (offset amount) is set to 3.8 mm. In this case, the clearance Dc is 0.36 mm, the stretch distance Dk is 3.0 mm, and the impedance during primary transfer is 7.6 log Ω. In the configuration of the present embodiment, the voltage to be applied to the primary transfer roller 14 necessary for supplying a correct primary transfer current from the primary transfer roller 14 to the photosensitive drum 2 to primarily transfer the toner image from the photosensitive drum 2 to the intermediate transfer belt 31 is about 880 V.

In the present embodiment, a clearance Dc of at least 0.15 mm is preferably secured for stable transfer in consideration of unpredictable events, such as an impact due to transportation of the image forming apparatus 100 and deformation of various members over time due to long-term use. Accordingly, in the arrangement of the present embodiment, the distance $D_{OS}$ is set to 3.8 mm so that a clearance Dc of 0.15 mm can be secured even if the distance $D_{OS}$ (offset amount) is reduced by 1.0 mm into 2.8 mm due to component tolerance.

Hardness and Thickness of Elastic Layer

Figure 14:
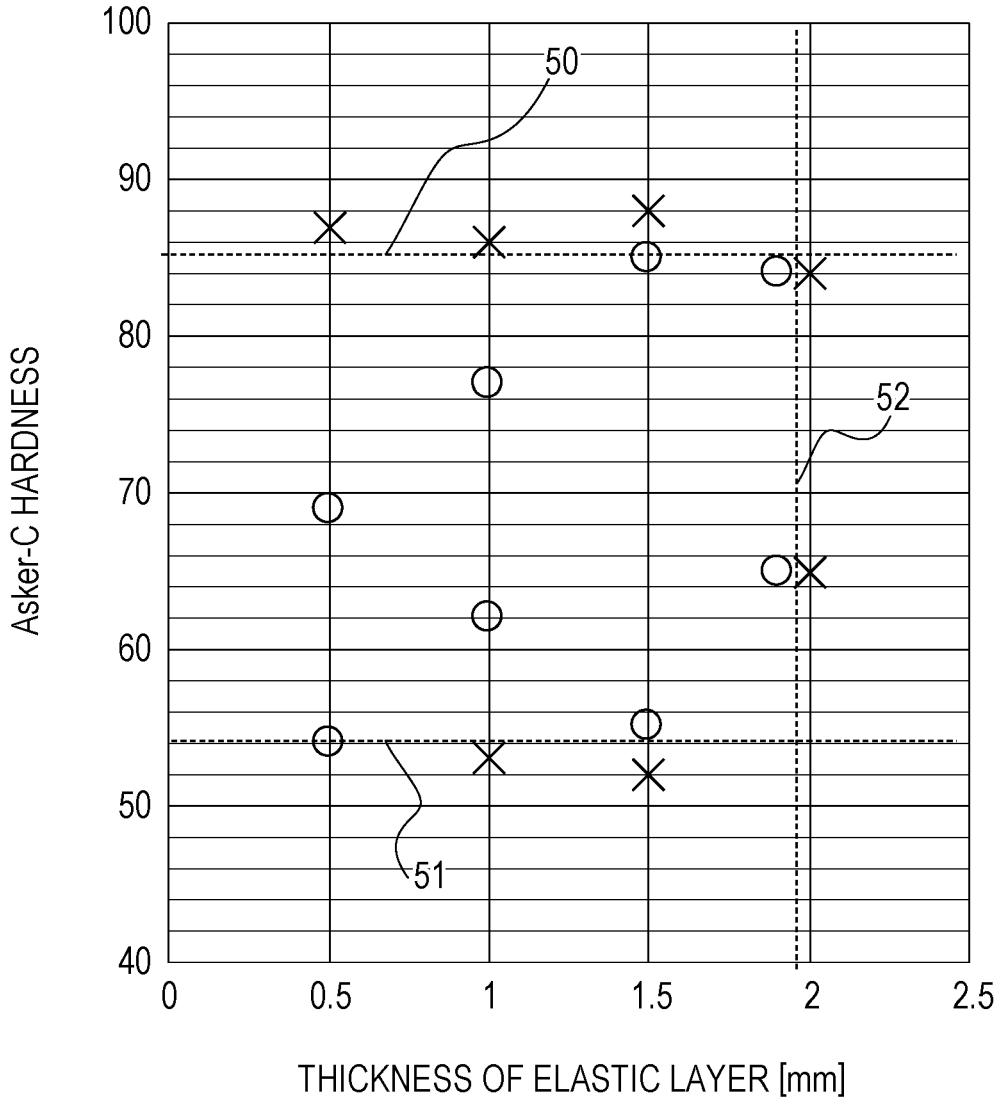
FIG. 14 is a graph illustrating the relationship between the thickness or the hardness of the elastic layer and the occurrence of an image defect in the third embodiment.

Next, the possible ranges of the hardness of the primary transfer roller 14 and the thickness of the elastic layer 21, obtained by an experiment, will be described. FIG. 14 is a graph illustrating the thickness of the elastic layer 21 that can be used for the primary transfer roller 14 of the present embodiment and the hardness of the primary transfer roller 14. In FIG. 14, the horizontal axis indicates the thickness of the elastic layer 21, and the vertical axis indicates the Asker-C hardness of the primary transfer roller 14.

The measurement of the hardness of the primary transfer rollers using an Asker-C hardness meter was conducted by applying a weight of 1 kg including the own weight of the hardness meter to the primary transfer roller including the core metal. Since the core metal 20 serves as a support for the elastic layer, the value of the Asker-C hardness obtained by measuring the hardness of the primary transfer roller can be regarded as the hardness of the elastic layer. In other words, the hardness of the elastic layer can be measured by pressing the needle of the hardness meter against the primary transfer roller toward the center of the core metal 20 from directly above in the vertical direction. In the following description, the hardness of the primary transfer roller, which is obtained by measuring the primary transfer roller, is regarded as the hardness of the elastic layer. The value of the hardness of the elastic layer increases as the hardness of the base rubber material increases and decreases as the hardness of the base material decreases. The value increases as the thickness of the elastic layer decreases and decreases as the thickness of the elastic layer increases.

To reduce the influence of an error, the hardness of the elastic layer was calculated by measuring the hardness at multiple portions using the above measuring method and averaging the measured values. More specifically, three portions of the primary transfer roller, the longitudinal center and opposite ends in the longitudinal direction, were measured four times at intervals of 90 degrees in the direction of rotation of the primary transfer roller, that is, a total of 12 portions of three longitudinal portions×four portions in the rotating direction, and the measured values were averaged to obtain the hardness of the elastic layer.

Hardness of Elastic Layer and Image Defect

Symbols o and x in FIG. 14 represent whether an image defect has occurred in the configurations of individual primary transfer rollers, in which o represents a configuration in which no image defect has occurred, and x represents a configuration in which an image defect has occurred. As illustrated in FIG. 14, the study in the present embodiment shows that an image defect occurred in the region whose Asker-C hardness is higher than a broken line 50, and also in the region whose Asker-C hardness is lower than a broken line 51.

Continuous use of the image forming apparatus 100 can cause foreign substances, such as dust, entering from the outside of the image forming apparatus 100 or foreign substances that have dropped in the image forming apparatus 100 to adhere to the primary transfer roller 14 and the intermediate transfer belt 31. In such a case, if the foreign substances reach the contact position between the primary transfer roller 14 and the intermediate transfer belt 31 while the primary transfer roller 14 is rotating with the movement of the intermediate transfer belt 31, an image defect due to the foreign substances can occur. More specifically, the foreign substances serve as spacers between the intermediate transfer belt 31 and the primary transfer roller 14, so that the surface property of the intermediate transfer belt 31 at the position to which the foreign substances adhere may change to cause an image defect due to the foreign substances.

The higher the hardness of the base rubber material or the smaller the thickness of the elastic layer 21, the more the image defect due to foreign substances can occur. In other words, the higher the Asker-C hardness obtained by measuring the primary transfer roller 14 (the hardness of the elastic layer 21), the more the image defect due to foreign substances tends to occur. A study in the present embodiment in which an image forming operation was executed, with foreign substances of 200 μm attached to the primary transfer roller 14, shows that an image defect due to the foreign substances occurred in a configuration in which primary transfer rollers 14 whose Asker-C hardness is larger than 85°, illustrated in FIG. 14, are used. The broken line 50 in FIG. 14 indicates a boundary for Asker-C hardness for the occurrence of an image defect due to foreign substances. Therefore, in order to reduce the occurrence of an image defect due to foreign substances, it is preferable to use a primary transfer roller 14 in which the Asker-C hardness of the elastic layer 21 is 85° or lower, obtained by measuring the primary transfer roller 14.

An image defect can also occur when the value of the primary transfer current flowing from the primary transfer roller 14 to the photosensitive drum 2 tends to be unstable, in addition to the image defect due to foreign substances. In the study of the present embodiment, the presence or absence of an image defect (uneven concentration) due to the unstable primary transfer current was evaluated using a half-tone image whose concentration is equal to or less than a predetermined value as an evaluation image.

The image defect due to the unstable primary transfer current tends to occur as the hardness of the base rubber material is lower or the thickness of the elastic layer is larger. This is because a decrease in material hardness or an increase in the thickness of the elastic layer makes it easy to deform the elastic layer because of the tension of the intermediate transfer belt. The deformation of the elastic layer because of the tension of the intermediate transfer belt makes the stretch distance Dk unstable, causing a possible change in impedance during primary transfer. In this case, the unstable primary transfer current causes an image defect.

The study of the present embodiment shows that an image defect due to an unstable primary transfer current occurred in the configuration in which primary transfer rollers whose Asker-C hardness is lower than 54°, illustrated in FIG. 14 are used. The broken line 51 in FIG. 14 indicates a boundary for Asker-C hardness for an image defect due to an unstable primary transfer current. Therefore, in order to reduce the occurrence of an image defect due to an unstable primary transfer current, it is preferable to use a primary transfer roller 14 in which the Asker-C hardness obtained by measuring the primary transfer roller 14 (the hardness of the elastic layer 21) is 85° or lower.

Thickness of Elastic Layer and Image Defect

In the case of a primary transfer roller 14 in which the thickness of the elastic layer 21 is 1.9 mm and the Asker-C hardness is 65° or 84°, no image defect occurred, as illustrated in FIG. 14. In contrast, with the configuration in which the thickness of the elastic layer 21 is 2.0 mm, an image defect occurred regardless of the value of the Asker-C hardness. This is caused by an unstable clearance Dc in the widthwise direction of the intermediate transfer belt 31 perpendicular to the moving direction of the intermediate transfer belt 31 due to the occurrence of deflection of the primary transfer roller 14 in the widthwise direction and a difference in disposition. For that reason, the thickness of the elastic layer 21 is preferably set to less than 2.0 mm, as indicated by the boundary of a broken line 52.

As described above, in the configuration of the present embodiment, primary transfer rollers 14 are used in which the thickness of the elastic layer 21 is less than 2.0 mm, and the Asker-C hardness is 54° or high and 85° or lower. This allows reducing the occurrence of an image defect caused by foreign substances and an image defect due to an unstable primary transfer current.

The elastic layer 21 may have a solid structure or a hollow structure, like sponge, provided that the Asker-C hardness is set within the range from 54° or higher and 85° or lower. Although, the present embodiment illustrates a configuration in which the distance $D_{OS}$ (offset amount) is set to 3.8 mm or more, and the clearance Dc including tolerance is not below 0.15 mm, the values are given for mere illustrative purposes. For example, if various tolerances that affect the clearance Dc can be decreased, the distance $D_{OS}$ (offset amount) may be set to a value less than 3.8 mm.

In the present embodiment, the offset amount is set so that the value of the clearance Dc including tolerance does not fall below 0.15 mm to prevent an image defect due to foreign substances of 200 μm or less. However, the clearance Dc may be set as appropriate according to the environment in which the image forming apparatus 100 is used and its service life. For example, in an environment in which foreign substances are unlikely to be generated and a case where the life is relatively short, so that the amount of foreign substances deposited is small, no image defect can occur even if the clearance Dc is decreased. With the configuration of the present embodiment, it is confirmed that foreign substances up to 50 μm do not affect the image even if the clearance Dc is 0 mm.

In the configuration of the present embodiment, an intermediate transfer belt 31 whose surface resistivity is 9.64 log [Ω/sq.] is used. This is given for mere illustrative purposes. With a primary transfer current of about 15 μA, when the surface resistivity of the intermediate transfer belt 31 is 11.0 log [Ω/sq.] or lower, the impedance at the primary transfer is 8.3 log [Ω] at a stretch distance Dk of about 0.5 mm, as illustrated in FIG. 13. According to FIG. 12, setting an offset amount so that the stretch distance Dk is about 0.5 mm secures a clearance Dc of about 0.05 mm, providing the above advantageous effects. Accordingly, to provide high primary transfer performance in the range of setting of the offset amount in the present embodiment, the value of the electrical resistance of the intermediate transfer belt 31 may be set within the following range. Specifically, the surface resistivity of the intermediate transfer belt 31 is preferably set to the range of 9.0 log [Ω/sq.] or higher and 13.0 log [Ω/sq.] or lower. More preferably, the surface resistivity of the intermediate transfer belt 31 is set to the range of 9.0 log [Ω/sq.] or higher and 11.0 log [Ω/sq.] or lower. This allows setting the voltage to be applied to the primary transfer roller 14 to a smaller value, allowing the power source configuration to be reduced in size and cost. In a configuration in which high transfer performance can be provided with a lower primary transfer current, an intermediate transfer belt having higher surface resistance can be employed.

In the present embodiment, the primary transfer roller 14 is disposed downstream from the photosensitive drum 2 in the moving direction of the intermediate transfer belt 31. Alternatively, the primary transfer roller 14 may be disposed upstream from the photosensitive drum 2 in the moving direction of the intermediate transfer belt 31 to have the same advantageous effect as those of the present embodiment.

Thus, the present embodiment uses the primary transfer roller 14 in which the core metal 20 is coated with the elastic layer 21, and the thickness of the elastic layer 21 and the Asker-C hardness are defined. This allows disposing the primary transfer roller 14 at an appropriate position with respect to the photosensitive drum 2, preventing the occurrence of an image defect due to foreign substances while reducing a decrease in transfer performance.

Although the present embodiment illustrates the intermediate transfer type image forming apparatus 100 using the intermediate transfer belt 31, this is given merely for illustrative purposes. An image forming apparatus of a direct transfer system including a conveying belt for conveying transfer materials P can offer the same advantageous effects as those of the present embodiment by using the primary transfer roller 14 described in the present embodiment.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-063893, filed Mar. 28, 2019, and No. 2019-096200, filed May 22, 2019, which are hereby incorporated by reference herein in their entirety.

What is claimed is:

1. An image forming apparatus comprising:

a rotatable image bearing member configured to bear a toner image;

a movable endless belt configured to come into contact with the image bearing member;

a transfer member disposed on an opposite side of the belt from the image bearing member, the transfer member configured to come into contact with the belt and primarily transfer the toner image from the image bearing member to the belt; and a secondary transfer member configured to secondarily transfer the toner image from the belt to a transfer material, after the toner image is primarily transferred from the image bearing member to the belt, wherein a moving speed of the belt and a moving speed of a surface of the image bearing member at a position where the image bearing member and the belt come into contact with each other differ from each other, wherein the transfer member is disposed upstream or downstream from a center of rotation of the image bearing member in a moving direction of the belt, the transfer member being urged toward the image bearing member to push the image bearing member via the belt to form a region where the belt winds around the image bearing member, and wherein the transfer member includes a core metal and an elastic layer coating on and contacting with an outer circumference surface of the core metal and having a thickness of less than 2.0 mm, the transfer member having an Asker-C hardness of 40° or higher and lower than 60°.

2. The image forming apparatus according to claim 1, further comprising:

a rotatable driving member configured to drive the belt to stretch and move the belt, wherein the driving member is configured to rotate to move the belt with a speed difference of 1.5% to 3.0% from the rotation speed of the image bearing member at the position where the image bearing member and the belt come into contact with each other.

3. The image forming apparatus according to claim 1, wherein the elastic layer contains an urethane resin.

4. The image forming apparatus according to claim 3, wherein the transfer member includes a rough surface on an outer circumference of the elastic layer.

5. The image forming apparatus according to claim 1, wherein the transfer member is disposed downstream from the center of rotation of the image bearing member in the moving direction of the belt.

6. The image forming apparatus according to claim 1, wherein the elastic layer has a thickness of more than 0.5 mm.

7. The image forming apparatus according to claim 1, wherein the elastic layer of the transfer member has a crown shape whose thickness is larger at a central portion than at opposite ends in a widthwise direction perpendicular to the moving direction of the belt.

8. An image forming apparatus comprising:

a rotatable image bearing member configured to bear a toner image;

a movable endless belt that comes into contact with the image bearing member;

a transfer member disposed on an opposite side of the belt from the image bearing member, the transfer member configured to come into contact with the belt and primarily transfer the toner image from the image bearing member to the belt; and a secondary transfer member configured to secondarily transfer the toner image from the belt to a transfer material, after the toner image is primarily transferred from the image bearing member to the belt, wherein the transfer member is disposed at a position upstream or downstream from a center of rotation of the image bearing member in a moving direction of the belt, the position being a position where the image bearing member is not pushed, and wherein the transfer member includes a core metal and an elastic layer coating on and contacting with an outer circumference surface of the core metal and having a thickness of less than 2.0 mm, the transfer member having an Asker-C hardness of 54° or higher and lower than 60°.

9. The image forming apparatus according to claim 8, wherein the elastic layer contains an urethane resin.

10. The image forming apparatus according to claim 9, wherein the transfer member includes a rough surface on an outer circumference of the elastic layer.

11. The image forming apparatus according to claim 8, wherein a distance from the center of rotation of the image bearing member to an axial center of the core metal is 10 mm or less in the moving direction of the belt.

12. The image forming apparatus according to claim 8, wherein a distance from the center of rotation of the image bearing member to an axial center of the core metal is 3.8 mm or more in the moving direction of the belt.

13. The image forming apparatus according to claim 8, wherein the transfer member is disposed downstream from the center of rotation of the image bearing member in the moving direction of the belt.

14. The image forming apparatus according to claim 8, wherein the belt has a surface resistivity of 9.0 log[Ω/sq.] or higher and 13.0 log[Ω/sq.] or lower.

15. The image forming apparatus according to claim 8, wherein the belt has a surface resistivity of 9.0 log[Ω/sq.] or higher and 11.0 log[Ω/sq.] or lower.

* * * * *